US006179386B1

(12) United States Patent
Meya et al.

(10) Patent No.: US 6,179,386 B1
(45) Date of Patent: Jan. 30, 2001

(54) DRIVE CHAIN CHANNEL ARRANGEMENT FOR LONGWALL SHEARER

(75) Inventors: Hans Meya; Gerhard Merten, both of Werne (DE)

(73) Assignee: DBT Deutsche Bergbau-Technik GmbH (DE)

( * ) Notice: Under 35 U.S.C. 154(b), the term of this patent shall be extended for 0 days.

(21) Appl. No.: 09/232,339

(22) Filed: Jan. 15, 1999

(30) Foreign Application Priority Data

Jan. 16, 1998 (DE) ..... 198 01 348

(51) Int. Cl.[7] ..... E21C 29/04
(52) U.S. Cl. ..... 299/43
(58) Field of Search ..... 299/42, 43, 47, 299/49

(56) References Cited

U.S. PATENT DOCUMENTS 4,099,786 * 7/1978 Nakajima et al. ..... 299/43
4,235,475 * 11/1980 Monks ..... 299/43
4,346,938 * 8/1982 Braun ..... 299/43
5,601,341 * 2/1997 Merten et al. ..... 299/43

FOREIGN PATENT DOCUMENTS

2445327 * 4/1975 (DE) ..... 299/43
44 23 925 11/1996 (DE) .

* cited by examiner

*Primary Examiner*—Thomas B. Will
*Assistant Examiner*—John Kreck
(74) *Attorney, Agent, or Firm*—Vickers, Daniels & Young

(57) ABSTRACT

In the driving and guide arrangement according to the invention, the drive chain in a chain channel bounded by a guide rail and a rear wall is supported only on series of spaced, narrow support elements at least some of which may form connecting plates welded between the rear wall and the guide rail. As the narrow support elements are spaced apart from one another, fines getting into the chain channel from above readily drop between them, and emerge freely through face side and gob-side discharge openings in the chain channel. Caking of fines in the chain channel is largely prevented in the arrangements, which are fabricated as welded constructions and are therefore particularly economical to produce.

20 Claims, 4 Drawing Sheets

DRIVE CHAIN CHANNEL ARRANGEMENT FOR LONGWALL SHEARER

FIELD OF THE INVENTION

The invention relates to a driving and guide arrangement for a mining machine which travels along a scraper chain conveyor, in particular for a drum cutter machine, with a guide rail arranged on the trough sections of the scraper chain conveyor above the level of the trough sections, and bounding a chain channel for a chain allowing the machine to haul itself along the mining face, with the horizontal links of the chain resting on support elements arranged within the chain channel, the latter being provided with openings underneath the chain to allow fines to fall through.

BACKGROUND OF THE INVENTION

An arrangement of this kind is known from DE-OS 4423925. In this arrangement the support elements for the horizontal links of a pin drive chain consist of support ledges extending over the length of the conveyor trough sections, with the vertical links of the pin drive chain engaging in, and practically entirely occupying, the slot-form space between the stowing-side and face-side ledges. The discharge openings for the fines in this known arrangement are open towards the gob or stowing side of the conveyor.

It has been found that the discharge of fines from the chain channel does not always function satisfactorily in the known construction. In most cases this is because the continuous support ledges and the vertical chain-links engaging in the space between them leave relatively little clearance for eg. coal dust etc. to fall through on its way to the fines discharge openings. Consequently, caking of fines on the pin drive chain in the chain channel is a frequent occurrence. As a result, a correct engagement of the chain-wheel in the pin drive chain is no longer assured, and there may even be damage to chain-wheel and guide.

It is the object of the invention to provide a particularly simple and inexpensive arrangement of the above-mentioned kind in which accumulations of fines in the chain channel accommodating the pin drive chain can be more reliably avoided, and an easier discharge of fines from the openings underneath the drive chain is obtained.

SUMMARY OF THE INVENTION

To achieve this object the support elements are formed as rest elements spaced apart from one other and engaging the horizontal chain-links from below, the individual rest elements having a limited dimension in the direction of travel of the mining machine, and the openings for discharge of fines are provided both on the stowing side of the chain channel and on its working front-facing side.

Utilizing only spaced elements that are themselves short or narrow in the travel direction of the mining machine as supports for the chain-links, fines which get into the chain channel have sufficient clearance between any two adjacent support elements on either side of the vertical chain-links to be able to fall to the bottom of the chain channel, whence they can re-emerge on the working side as well as on the gob side. This arrangement largely eliminates the risk of accumulations of fines and caking or clogging in the chain channel.

In a preferred form of the invention, the chain channel is made as a welded construction bounded on its working, front-facing side by the guide rail and on its rear, gob side by a rear wall, and welded connecting plates interconnect the rear wall and the guide rail. This configuration as a welded construction yields considerable cost and weight benefits. A particularly convenient arrangement is obtained by forming the connecting plates as support elements for the horizontal chain-links and providing them with recesses for the vertical chain-links. The connecting plates then perform a dual role, as they not only provide the bridge between the guide rail and rear wall components which bound the chain channel, but simultaneously serve as support elements for the chain-links. The lower region of the rear wall may be bent towards the guide rail, so as to bound the chain channel at the bottom as well as at the rear.

The guide rail preferably consists essentially of a rolled or extruded section, which can have smaller dimensions and weights in comparison with the cast section that is still often used, and to which the connecting plates can be welded without any problem. The smaller dimensions and weights and the good weldability of the components can result in quite considerable cost advantages in relation to known designs. The fines discharge openings can consist basically of cutouts in the rear wall and/or guide rail, located between the connecting plates, preferably of trapezium form with the wider parallel side at the base. A particularly advantageous configuration is obtained by locating the guide rail a certain distance above the bottom boundary of the chain channel on the front side of the chain channel, thus forming between the guide rail and the bottom boundary of the chain channel a front fines discharge opening which can then conveniently extend over the whole length of the conveyor trough sections and/or of the chain channel itself. In this case, a guide shoe may be arranged on the mining machine so as to project through the front discharge opening to the conveyor trough and underneath the guide rail. This guide shoe not only serves to guide the drum cutter machine or its equivalent correctly on the guide arrangement, but additionally may be formed as a kind of scraper which rakes out any fines which have not already emerged from the chain channel through the discharge opening.

The upper part of the guide rail may have a rail profile for a slide block and/or for one or more running wheels of the mining machine. In this case it is particularly advantageous for the rail profile to be approximately semicircular, engaging in a matching groove in the periphery of a running wheel. With this configuration, the mining machine is guided in a positive manner transversely with respect to its direction of travel. It is convenient to provide the guide rail with a projection in the region of the rail profile or of the lower edge of the rail, which overhangs a derailment preventer arranged on the mining machine. This will ensure that the running wheel or slide block of the mining machine cannot be derailed.

The guide rail is conveniently provided, in a manner known in itself, with ledge-like projections which protrude into the chain channel and overhang the face-side shanks of the horizontal chain-links inside the chain channel. These projections prevent the drive chain from being lifted out of the chain channel. In a similar fashion, retaining bars can also be releasably attached on the stowing side of the chain channel after the chain has been inserted, so that these bars overhang the stowing-side shanks of the horizontal chain-links. After the retaining bars have been removed, the drive chain can be laid in the chain channel from above, or removed from above when replacement is necessary.

The bottom boundary of the chain channel may be given a ridged, somewhat roof-like form, in which the ridge may be located approximately in the longitudinal centre plane of the chain channel and chute surfaces for the fines falling away on either side of the ridge to the fines discharge openings. The provision of such sloping chute surfaces assists the unhindered discharge of the fines which have entered the chain channel.

Further features and advantages of the invention will be apparent from the description which follows and from the drawings, in which preferred embodiments of the invention are described in detail with reference to some examples.

DESCRIPTION OF THE PREFERRED EMBODIMENTS

Figure 1:
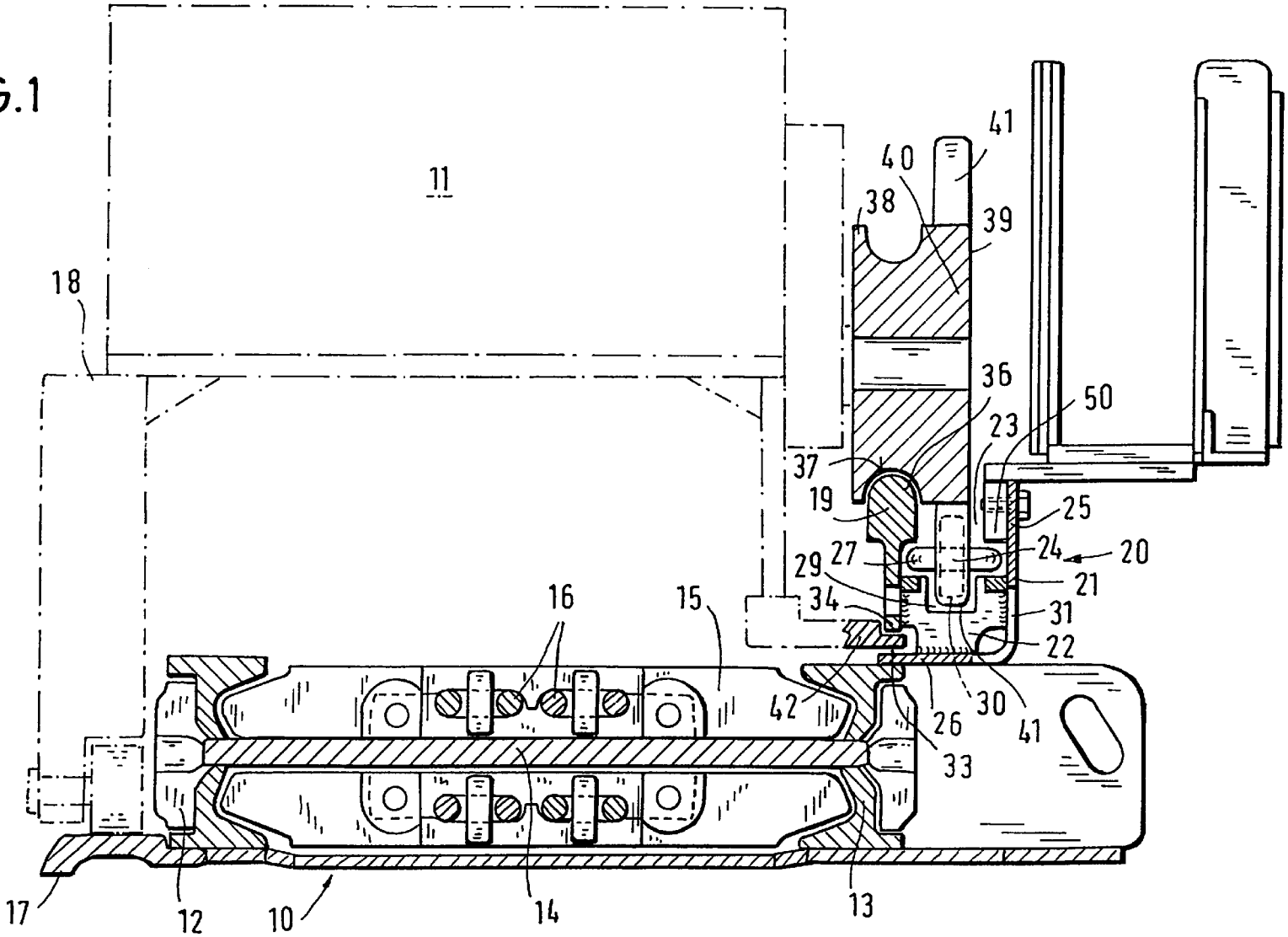
FIG. 1 is an end view, partly in section, showing an individual trough section of a scraper chain conveyor with a pin drive and guide arrangement according to the invention mounted on the gob side of the conveyor trough.

The scraper chain conveyor used as a longwall face conveyor in underground mining normally consists of individual trough sections which are joined to one another with no longitudinal play, but with limited angular play; a single such trough section 10 together with its mountings is shown in the drawing in FIG. 1. The drum cutter machine 11, which straddles the scraper chain conveyor and travels along it for coal getting, is merely indicated in the drawing by chain-dotted lines. The trough sections 10 which together form the conveyor trough of the scraper chain conveyor consist, in a manner known in itself, of side-profiles 12 and 13 which are disposed symmetrically with respect to each other and are connected to each other by the conveyor deck 14. An endless scraper chain loop, which in the illustrated example consists of a double centre endless chain loop 16, with scraper flights 15 attached, runs in the troughs of the trough sections 10 bounded by the side-profiles and the conveyor deck. A running track 17 upon which the cutter machine is supported and guided by working-side track rollers 18 is mounted at the foot of the working-side profile 12 of the trough sections 10. The drum cutter machine, which straddles the scraper chain conveyor, is guided on the gob side on guide rails 19 which are secured above the trough sections 10 and the gob-side side profiles 13 and which form part of a pin drive and guide arrangement 20, the subject of the present invention.

The pin drive and guide arrangement 20 essentially comprises for each conveyor trough section 10 an angle section 21 or profile member extending over the entire length of the trough section and the guide rail 19 likewise extending over the length of the trough section. The angle section 21 and the guide rail 19 are joined to one other by a plurality of connecting plates 22 which are welded to them at intervals, thus forming a chain channel 23 to receive a pin drive chain 24. This chain channel 23 is bounded on the gob side by a rear wall 25 formed by the angle section 21, on the working side by the guide rail 19, and on the underside by a bottom chain channel boundary enclosure 26 formed by the second leg of the angle section 21.

The pin drive chain 24 lies with its horizontal chain-links 27 resting firstly on narrow rest bars 28 protruding a short way into the chain channel from the rear wall and from the guide rail, and partly on the narrow connecting plates 22 located between every two rest bars, the connecting plates 22 being provided for this purpose with recesses 29 which the vertical chain-links 30 can enter.

The chain channel 23 has fines discharge openings 31, 32 both on the gob side and on the working side, between the chain channel bottom boundary 26 on the one hand and rear wall 25 or guide rail 19 on the other hand. The rearward discharge openings 31 in the rear wall 25 are each located between two adjacent connecting plates 22, and each has the shape of a trapezium with the wider parallel side at the chain channel bottom boundary 26. In the embodiments shown in FIGS. 1, 2, 3 and 6, the working side fines discharge openings 32 are formed as a continuous discharge channel 33 which extends over the entire length of the individual trough sections 10. In order to form this discharge channel 33, the feet 34 of the guide rails 19 are not placed on the chain channel bottom boundary 26, but are welded to the connecting plates 22 to lie some distance above the bottom boundary.

In the embodiments shown in FIGS. 1, 2, 3 and 6, the guide rails 19 are also provided with additional discharge openings 35, approximately oval in shape, immediately below the rest bars 28.

Figure 3:
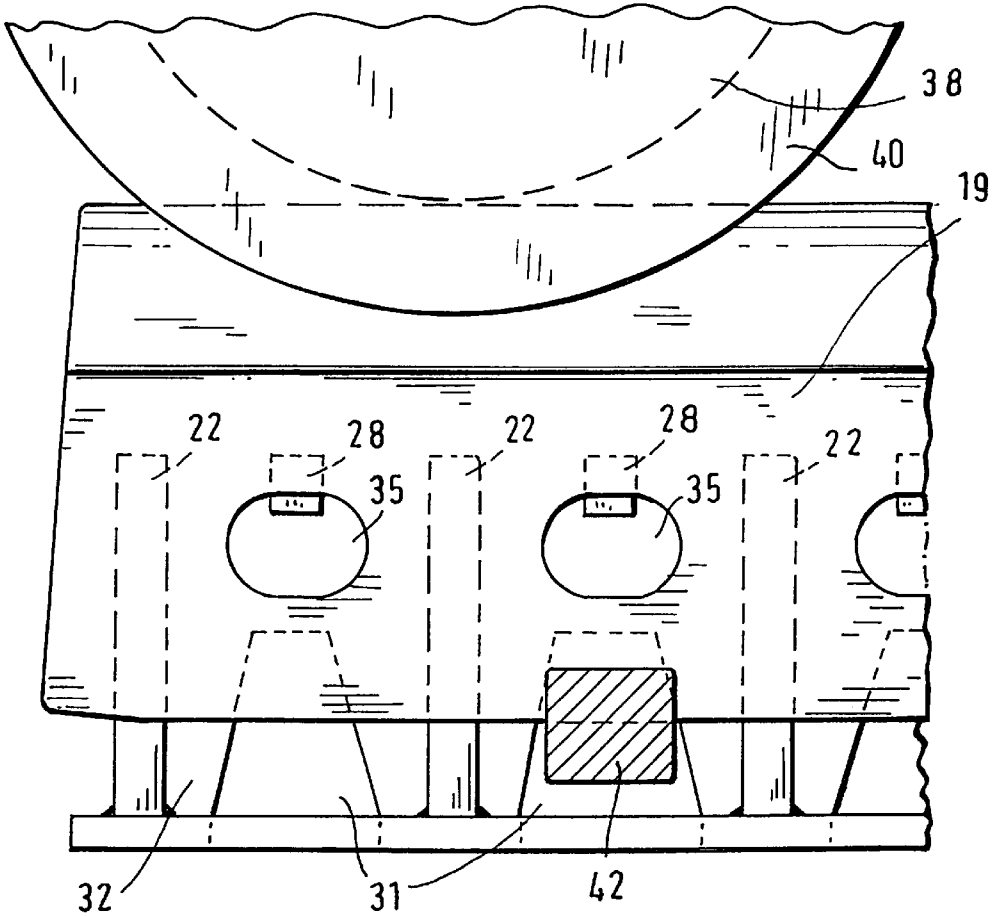
FIG. 3 is a view of the region shown in FIG. 2, as seen in the direction of the arrow III.
Figure 2:
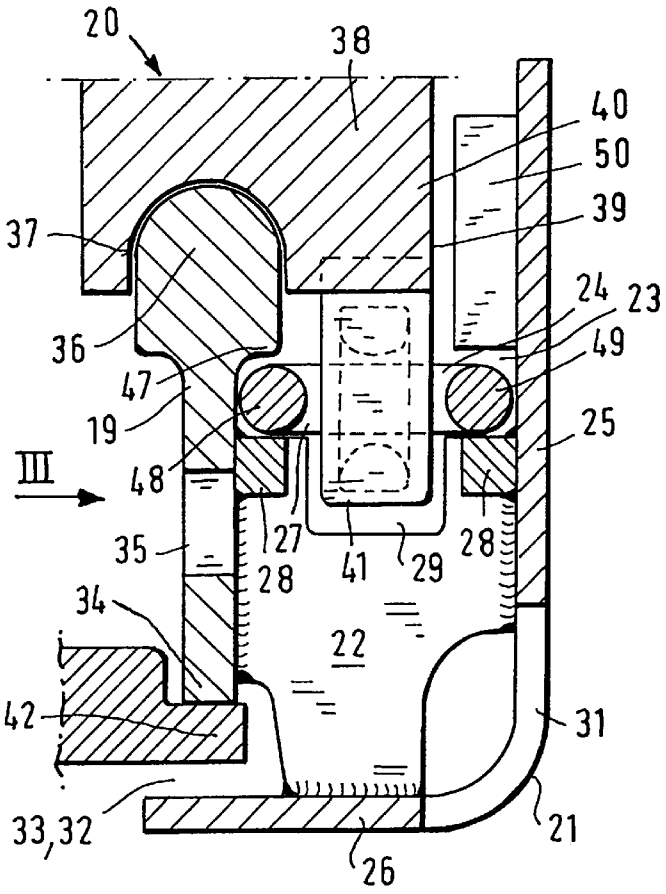
FIG. 2 is an enlarged sectional view of the pin drive and guide arrangement mounted on the conveyor trough shown in FIG. 1.

In the embodiment of the invention shown in FIGS. 1 to 3, the guide rails have at the top a profile 36 with an approximately semicircular cross-section 36 which engages in a matching groove 27 in a running wheel 38 of the cutter machine 11. The running wheel 38 is provided on its gob-side outer face 39 with the pin drive sprocket 40, the teeth 41 of which engage between adjacent vertical links 30 of the pin drive chain 24 lying in the chain channel and thus with rotation of the running wheel 38 haul the cutter machine 11 along the conveyor. To prevent the running wheel 38 from lifting off the guide rail 19, the drum cutter machine is provided with a derailment preventer 42 which projects under the foot 34 of the guide rail 19 into the discharge channel 33. This arrangement ensures that the cutter machine is not only guided transversely with respect to the running direction of the machine because of the interlocking forms of the running wheel and rail profile cross-sections, but also that it cannot be accidentally derailed.

Figure 4:
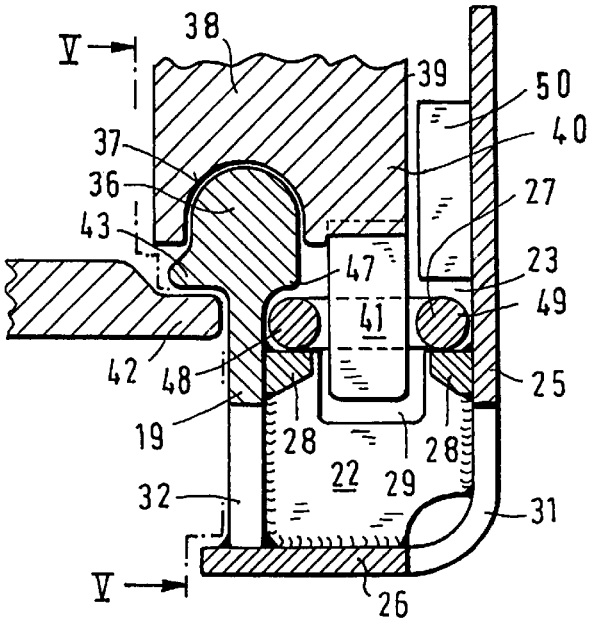
FIG. 4 shows a second embodiment of a pin drive and guide arrangement according to the invention, in a similar view to FIG. 2.
Figure 5:
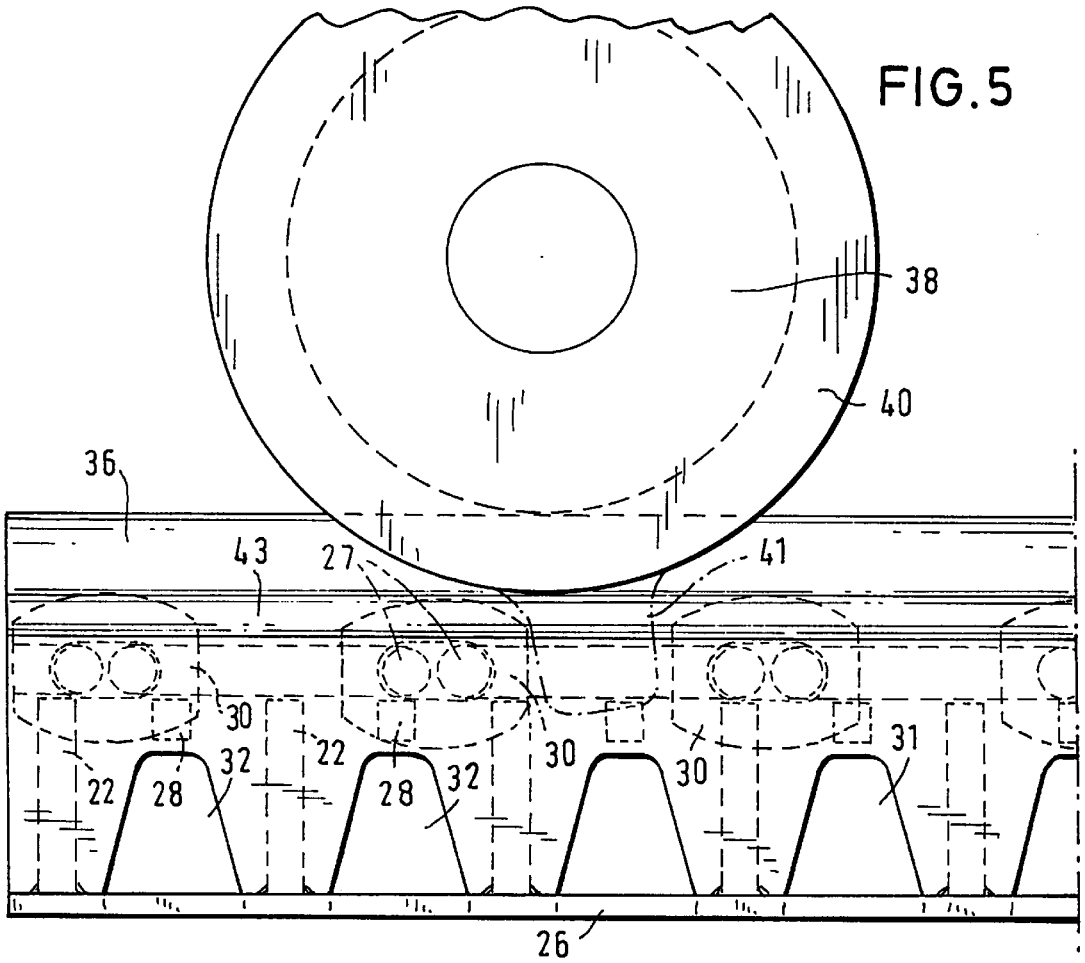
FIG. 5 is a view of the region in FIG. 4, as seen in the direction of the arrow V.

The same applies to the embodiment according to FIGS. 4 and 5, in which the guide rail is provided with an additional projection 43 which overhangs the derailment preventer 42 arranged on the getting machine 11.

In the pin drive and guide arrangements which have been described and illustrated, fines, such as coal dust or the like, entering the chain channel 23 from above descend between—and largely unhindered by—the connecting plates 22 and rest bars 28, since these have a limited extent in the travel direction, and can be discharged through the fines discharge openings 31, 32, 33 and 35 both towards the gob side and towards the working side. Because the cross-sections of the discharge openings are relatively large and because there are sufficiently large gaps between the connecting plates 22 and the rest bars 28, there is no tendency for the fines to cake and clog the chain channel. With the embodiment shown in FIG. 2, an additional chain channel cleaning action can be obtained by constructing the derailment preventer 42 engaging in the discharge channel as a scraper which scrapes the chain channel as it moves along the foot 34 of the guide rail, at least as far as the connecting plates, and rakes out the fines through the discharge channel 33 and/or towards the rear fines discharge openings 31.

Figure 6:
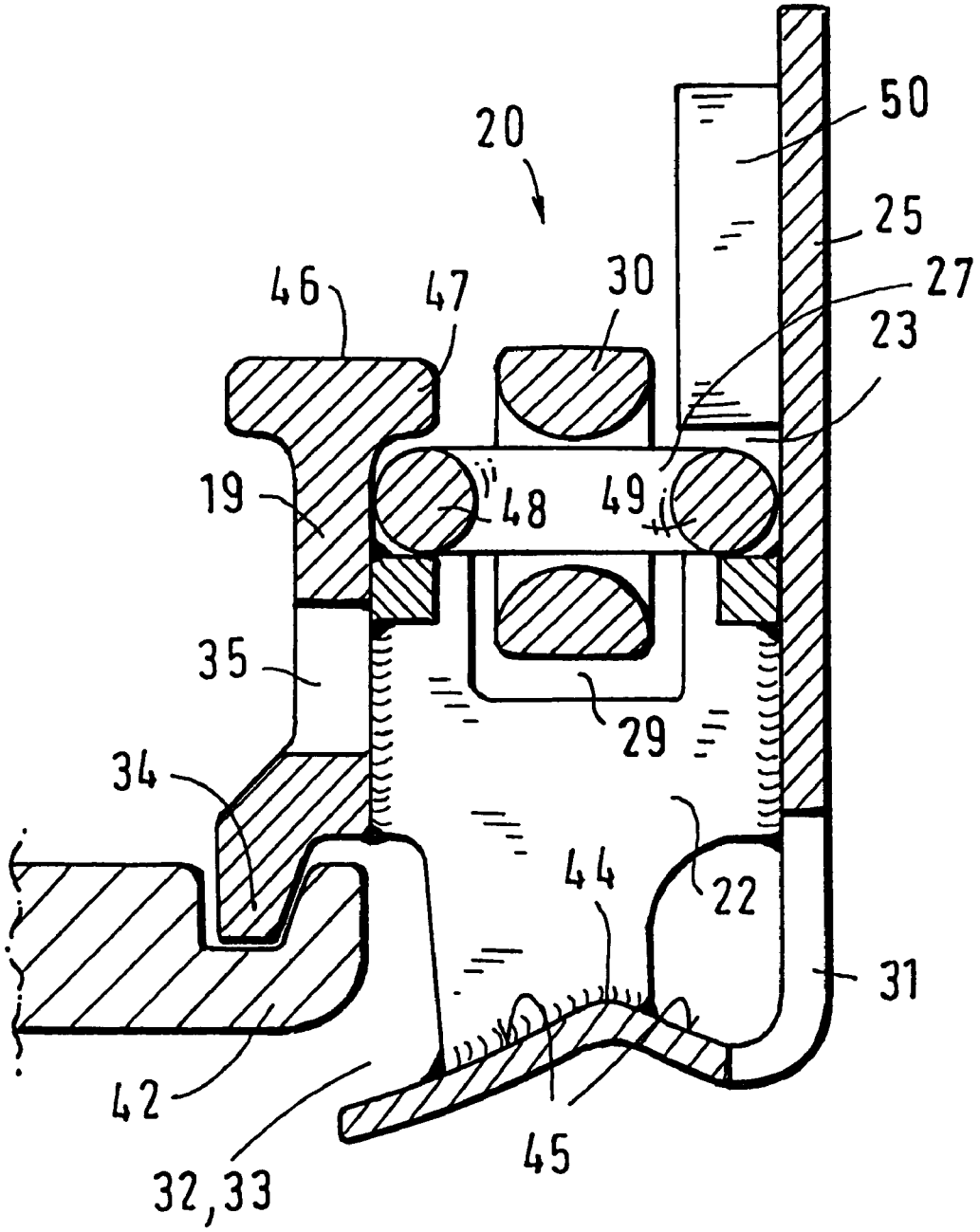
FIG. 6 shows, in cross-section, a third embodiment of an arrangement according to the invention.

In the embodiment shown in FIG. 6, the discharge of fines is additionally assisted by giving the bottom boundary 26 of the chain channel 23 a convex or roof-shaped form, with a ridge 44 extending approximately along the chain channel 23 in the longitudinal centre plane of the channel, and with chute surfaces 45 for the fines falling away on either side of the ridge 44 to the fines discharge openings 31, 32. In this embodiment, fines dropping through the chain channel from above fall on the sloping chute surfaces and are at once led down the slopes and out through the discharge openings.

The rail profile 36 illustrated in this embodiment has a flat upper surface 46 for a running wheel (not shown in the drawing) which has no special profile on its periphery.

To prevent the chain from being unintentionally lifted out of the chain channel while the machine is in operation, projections 47 which overhang the working side shanks 48 of the horizontal chain-links 27 in the chain channel, are formed by the guide rail in all the illustrated embodiments, in the region of its rail profile 36. The gob-side shanks 49 are similarly retained in the chain channel by releasably attaching a retaining bar 50 or the like to the working side of the rear wall 25, as indicated in FIG. 1. This retaining bar together with the shoulders 47 on the rail profile keeps the pin drive chain on the rest bars 28 and connecting plates 22, and prevents it from creeping out of the chain channel, which is open at the top. With the retaining bar 50 removed, the pin drive chain 24 can, with a slight twist, be laid in the chain channel of the conveyor trough sections from above, or lifted out of the chain channel again when chain replacement is necessary.

What is claimed is:

1. A driving and guide arrangement for use with a mining machine and a scraper chain conveyor along which said mining machine is arranged to travel wherein said scraper chain conveyor having an elongate trough, said driving and guide arrangement comprising:

a chain channel for location on and above the conveyor trough and a driving chain having a series of horizontal links and located in said channel for engagement by the mining machine for said travel of the machine, the chain channel having a front, face-side boundary and a rear, gob-side boundary, said boundaries being opposed to each other and extending in the direction of travel of said machine, and support elements for supporting at least a portion of each of said horizontal links of said driving chain, a guide rail for said mining machine at one of said chain channel boundaries, said support elements being comprised of a series of narrow, individual elements having limited extent in said travel direction, said elements being spaced apart from each other and extending along each of said boundaries in said travel direction, said elements projecting inwardly into said chain channel from each of said boundaries and being fixedly attached thereto, openings for the discharge of fines from the chain channel being provided at both said side boundaries of the chain channel.

2. The driving and guide arrangement of claim 1, wherein the chain channel is a welded construction, said guide rail forming a front, face-side wall of said welded construction and interconnecting plates of said welded construction extending transversely across the channel between the guide rail and a rear, gob-side wall of the channel.

3. The driving and guide arrangement of claim 2, wherein cut-outs in at least one of said front and rear walls of the chain channel between the connecting plates provide at least some of said fines discharge openings.

4. The driving and guide arrangement of claim 3, wherein at least some of the cut-outs have a trapezoidal form comprising a pair of unequal parallel sides with the wider of said parallel sides forming a base of the cut-out.

5. The driving and guide arrangement of claim 1, wherein the guide rail consists essentially of a rolled or extruded section.

6. The driving and guide arrangement of claim 1, wherein an upper part of the guide rail has a profiled face for guidance of a slide block or a running wheel of the mining machine.

7. The driving and guide arrangement of claim 6, wherein said profiled face is approximately semi-circular for engagement with a complementary concave recess in the running wheel of the mining machine.

8. The driving and guide arrangement of claim 1, wherein a lateral projection is provided on the guide rail for overhanging a derailment preventer mounted on the mining machine.

9. The driving and guide arrangement for use with a mining machine and scraper chain conveyor along which said mining machine is arranged to travel, wherein said scraper chain has an elongated trough, said driving and guide arrangement comprising:

a chain channel for location on and above the conveyor trough and a driving chain in said channel for engagement by the mining machine for said travel of the machine, the chain channel having a front, face-side boundary and a rear, gob-side boundary, said boundaries being opposed to each other and extending in the direction of travel of said machine, and support elements projecting inwardly into the chain channel from said boundaries, a guide rail for said mining machine at one of said chain channel boundaries, at each said boundary the support elements being provided by a series of narrow elements of limited extent in said travel direction and spaced apart from each other in said travel direction, the driving chain having a series of horizontal chain links resting on said support elements in the chain channel, openings for the discharge of fines from the chain channel being provided at both said side boundaries of the chain channel, said chain channel being of welded construction, said guide rail forming a front, face-side wall of said welded construction and interconnecting plates of said welded construction extending across the channel between the guide rail and a rear, gob-side wall of the channel, the interconnecting plates providing at least some of said support elements for the horizontal chain links and having recesses formed in the interconnecting plates to provide clearance for vertical chain links of the driving chain.

10. The driving and guide arrangement for use with a mining machine and scraper chain conveyor along which said mining machine is arranged to travel, said scraper chain having an elongated trough, said driving and guide arrangement comprising:

a chain channel for location on and above the conveyor trough and a driving chain in said channel for engagement by the mining machine for said travel of the machine, the chain channel having a front, face-side boundary and a rear, gob-side boundary, said boundaries being opposed to each other and extending in the direction of travel of said machine, and support elements projecting inwardly into the chain channel from said boundaries, a guide rail for said mining machine at one of said chain channel boundaries, at each said boundary the support elements being provided by a series of narrow elements of limited extent in said travel direction and spaced apart from each other in said travel direction, the driving chain having a series of horizontal chain links resting on said support elements in the chain channel, openings for the discharge of fines from the chain channel being provided at both said side boundaries of the chain channel, said chain channel being of welded construction, said guide rail forming a front, face-side wall of said welded construction and interconnecting plates of said welded construction extending across the channel between the guide rail and a rear, gob-side wall of the channel, and said welded construction of said chain channel being further comprised of an extension of a lower region of said rear wall and said extension being bent towards the guide rail to form a bottom boundary of the chain channel.

11. The driving and guide arrangement for use with a mining machine and scraper chain conveyor along which said mining machine is arranged to travel, wherein said scraper chain having an elongated trough, said driving and guide arrangement comprising:

a chain channel for location on and above the conveyor trough and a driving chain in said channel for engagement by the mining machine for said travel of the machine, the chain channel having a front, face-side boundary and a rear, gob-side boundary, said boundaries being opposed to each other and extending in the direction of travel of said machine, and support elements projecting inwardly into the chain channel from said boundaries, a guide rail for said mining machine at one of said chain channel boundaries, at each said boundary the support elements being provided by a series of narrow elements of limited extent in said travel direction and spaced apart from each other in said travel direction, the driving chain having a series of horizontal chain links resting on said support elements in the chain channel, openings for the discharge of fines from the chain channel being provided at both said side boundaries of the chain channel, and the guide rail terminating above the bottom of the chain channel, thereby providing a discharge opening for fines from the front boundary of the channel between the guide rail and a bottom boundary of the chain channel.

12. The driving and guide arrangement of claim 11, wherein said discharge opening extends below said guide rail continuously along the length of the chain channel for receiving a derailment preventer on the mining machine, said derailment preventer projecting through said opening below the lower face of said guide rail.

13. The driving and guide arrangement for use with a mining machine and scraper chain conveyor along which said mining machine is arranged to travel, wherein said scraper chain has an elongated trough, said driving and guide arrangement comprising:

a chain channel for location on and above the conveyor trough and a driving chain in said channel for engagement by the mining machine for said travel of the machine, the chain channel having a front, face-side boundary and a rear, gob-side boundary, said boundaries being opposed to each other and extending in the direction of travel of said machine, and support elements projecting inwardly into the chain channel from said boundaries, a guide rail for said mining machine at one of said chain channel boundaries, at each said boundary the support elements being provided by a series of narrow elements of limited extent in said travel direction and spaced apart from each other in said travel direction, the driving chain having a series of horizontal chain links resting on said support elements in the chain channel, openings for the discharge of fines from the chain channel being provided at both said side boundaries of the chain channel, and said guide rail having at least one projection extending into the chain channel to overhang face side shanks of the horizontal chain links in the chain channel.

14. The driving and guide arrangement for use with a mining machine and scraper chain conveyor along which said mining machine is arranged to travel wherein said scraper chain has an elongated trough, said driving and guide arrangement comprising:

a chain channel for location on and above the conveyor trough and a driving chain in said channel for engagement by the mining machine for said travel of the machine, the chain channel having a front, face-side boundary and a rear, gob-side boundary, said boundaries being opposed to each other and extending in the direction of travel of said machine, and support elements projecting inwardly into the chain channel from said boundaries, a guide rail for said mining machine at one of said chain channel boundaries, at each said boundary the support elements being provided by a series of narrow elements of limited extent in said travel direction and spaced apart from each other in said travel direction, the driving chain having a series of horizontal chain links resting on said support elements in the chain channel, openings for the discharge of fines from the chain channel being provided at both said side boundaries of the chain channel, and the chain channel having a bottom boundary comprising a ridge extending along the channel and downwardly inclined chute surfaces to each side of said ridge for assisting the discharge of fines through the discharge openings in the opposed boundaries of the channel.

15. A driving and guide arrangement for use with a mining machine and a scraper chain conveyor along which said mining machine is arranged to travel, said driving and guide arrangement comprising:

a chain channel including a front, face-side boundary longitudinally extending in the direction of travel of said mining machine; a longitudinally extending rear, gob-side boundary transversely spaced from and extending parallel to said front boundary; and a plurality of longitudinally spaced connecting plates extending transversely across said channel and being welded to each of said boundaries;

a driving chain longitudinally extending through said chain channel for engagement by said mining machine and being supported therein by said connecting plates, said driving chain having a plurality of interspaced horizontal and vertical links; and, each connecting plate having a thickness less than the pitch of a horizontal link, a top edge surface positioned beneath top edge surfaces of said front and rear boundaries adapted to support, a horizontal link and a central recess adapted to receive a vertical link.

16. The driving and guide arrangement of claim 15, wherein one of said front or said rear boundaries is comprised of a guide rail for said mining machine.

17. The driving and guide arrangement of claim 15, wherein one of said front or said rear boundaries has an extension of a lower region thereof, said extension being bent towards the other of said boundaries to form a bottom boundary and said connection plates welded to said bottom boundary.

18. The driving and guide arrangement of claim 15, wherein said chain channel includes discharge openings for the passage of fines collecting within said chain channel, said discharge openings extending along each of said front and said rear boundaries.

19. The driving and guide arrangement of claim 15, wherein said chain channel include support elements for supporting said driving chain, said support elements extending along each of said front and said rear boundaries, said elements being longitudinally spaced apart and positioned between said connecting plates, and said element projecting inwardly into said channel from each of said front and said rear boundaries and being welded thereto.

20. The driving and guide arrangement of claim 19, wherein said support elements have a thickness in the direction of travel of said machine, and said elements being spaced apart in the direction of travel of said machine a distance equal to or greater than said thickness of said support elements.

* * * * *